US008338708B2

(12) United States Patent
Maebashi et al.

(10) Patent No.: US 8,338,708 B2
(45) Date of Patent: Dec. 25, 2012

(54) ELECTRIC JUNCTION BOX JOINT STRUCTURE

(75) Inventors: Akemi Maebashi, Kakegawa (JP); Shigeharu Tsukui, Kakegawa (JP)

(73) Assignee: Yazaki Corporation, Tokyo (JP)

( * ) Notice: Subject to any disclaimer, the term of this patent is extended or adjusted under 35 U.S.C. 154(b) by 524 days.

(21) Appl. No.: 12/588,753

(22) Filed: Oct. 27, 2009

(65) Prior Publication Data

US 2010/0144170 A1 Jun. 10, 2010

(30) Foreign Application Priority Data

Dec. 8, 2008 (JP) ..... 2008-312050

(51) Int. Cl.
*H01R 4/22* (2006.01)

(52) U.S. Cl. ..... 174/87; 439/76.2

(58) Field of Classification Search ..... 174/84 R, 174/84–85, 87; 439/76.2, 620.27
See application file for complete search history.

(56) References Cited

U.S. PATENT DOCUMENTS

| | | | | | |
|---|---|---|---|---|---|
| 4,909,745 | A | * | 3/1990 | Hayashi | 439/76.2 |
| 5,099,089 | A | * | 3/1992 | Zan | 174/87 |
| 5,427,270 | A | * | 6/1995 | Patterson | 174/135 |
| 6,022,247 | A | * | 2/2000 | Akiyama et al. | 439/701 |
| 6,129,560 | A | * | 10/2000 | Baur et al. | 439/76.1 |
| 6,172,300 | B1 | | 1/2001 | Kawaguchi | |

FOREIGN PATENT DOCUMENTS

| | | |
|---|---|---|
| JP | 11-252747 | 9/1999 |
| JP | 2004-088946 | 3/2004 |

* cited by examiner

*Primary Examiner* — Michael Zarroli
(74) *Attorney, Agent, or Firm* — Edwards Wildman Palmer LLP

(57) ABSTRACT

An electric junction box is provided having a receiving portion enabling a joint to be securely press-fitted into a joint, even if the outer diameter of the joint varies within a wide range. An electric junction box is comprised of a joint having electrical conduits that are electrically connected to each other at their terminals, and a cap disposed on the terminals, and a receiving portion which the joint is press-fitted into. The receiving portion comprises a recess having an inner surface facing an outer surface of the joint, and a rib projection disposed on the inner surface of the recess. The rib projection has a tapered portion inclined toward the bottom of the recess thus approximating the center portion of the bottom.

2 Claims, 5 Drawing Sheets

FIG. 5 -- Prior Art --
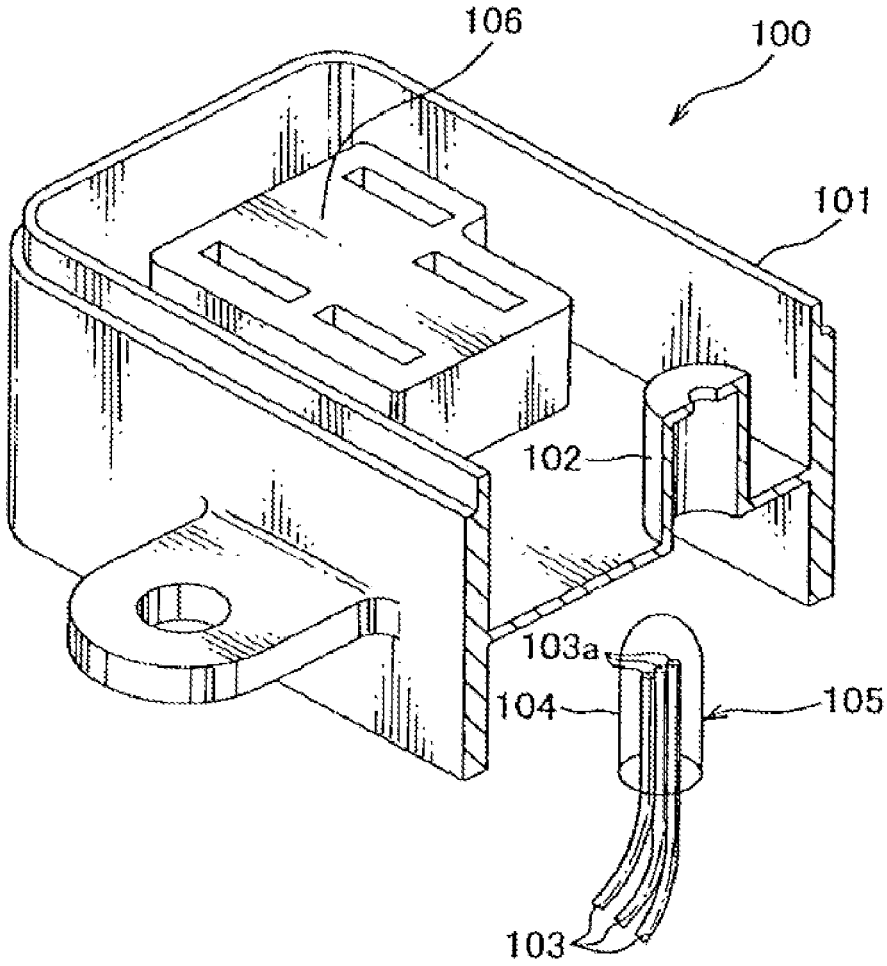

ELECTRIC JUNCTION BOX JOINT STRUCTURE

CROSS-REFERENCE TO RELATED APPLICATIONS

The present application claims priority of Japanese Patent Application No. 2008-312050 filed on Dec. 8, 2008, the disclosure of which is expressly incorporated by reference herein in its entirety.

BACKGROUND OF THE INVENTION

1. Field of the Invention

The present invention is an electric junction box suited to be mounted to an engine room for a vehicle.

2. Description of the Related Art

A wide variety of electronic devices are mounted to a vehicle. In order to supply electrical energy to such an electronic device, an electric junction box that includes an electrical component such as a fuse and a relay, and is disposed between an electronic power source and the afore-mentioned electronic device has been proposed.

The electric junction box may be also called as a "junction block", a "fuse block", or a "relay block". These terms can be interchangeably used herein.

FIG. 5 shows a cross-sectional view of a conventional electric junction box.

The junction box 100 is shown to include a case body 101 formed of synthetic resin. For more detail, see Japanese publication of patent application No. H11-252747. The case body 101 includes a receiving portion 102 capable of receiving a joint 105 having a cap 104 covering terminal portions 103*a* of electrical conduits 103, as well as a portion 106 for mounting an electronic part thereto. In the area of the joint 105, a plurality of electrical conduits 103 is connected to each other.

The cap 104 is bag-shaped, and is formed of material which has a tendency to contract when heat is applied, thereto. The cap 104 is configured to protect the terminal portion 103*a* of the electrical conduit 103 from liquid such as water, and any damage. In practice, a plurality of terminals 103 is also protected due to the cap 104 from being separated from each other.

The receiving portion 102 has a recess. In particular, the receiving portion 102 is made tubular having a wall in its one end portion. The receiving portion 102 has a diameter enough to hold the joint 105 therein. The joint 105 is press-fitted into the receiving portion 102 through an opening disposed in the receiving portion 102.

However, there are several drawbacks and problems in the afore-mentioned conventional electric junction box 100. In detail, once the cap 104 is subject to heat, it is contracted. In this situation, the outer diameter of the afore-mentioned joint 105 generally varies within a wide range. For example, in a case where the outer diameter of the joint 105 is made extremely small or narrow, a clearance or gap is caused between the joint 105 (i.e., the outer surface of the joint 105) and the inner face of the receiving portion 102. In this situation, the joint 105 is not allowed to be securely inserted into the receiving 102, as well as, to be well press-fitted into the receiving portion 102. In addition, the joint 105 should be fixed to the receiving portion 102 by means of an adhesive tape, a pressure sensitive tape or sheet, and so on. Accordingly, required parts and efforts are correspondingly increased.

SUMMARY OF THE INVENTION

The present invention is provided to solve the above drawbacks and problems. In particular, there is provided an electric junction box having a receiving portion enabling a joint to be securely press-fitted thereinto, even if the outer diameter of the joint varies within a wide range.

In particular, there is provided an electric junction box comprising a joint in which terminals of electrical conduits are electrically connected to each other, the terminals being covered by a cap, and a receiving portion which the joint is press-fitted into. The receiving portion comprises a recess having an inner surface facing an outer surface of the joint, and a rib projection disposed on the inner surface of the recess. The rib projection has a tapered portion inclined toward the bottom of the recess thus approximating the center portion of the bottom.

Preferably, the tapered portion extends from the bottom of the recess, and is arranged in a position where only a tip portion of the joint is located.

BRIEF DESCRIPTION OF THE DRAWINGS

FIG. 5 is a cross sectional view of a conventional electric junction box.

DETAILED DESCRIPTION OF THE INVENTION

Figure 1:
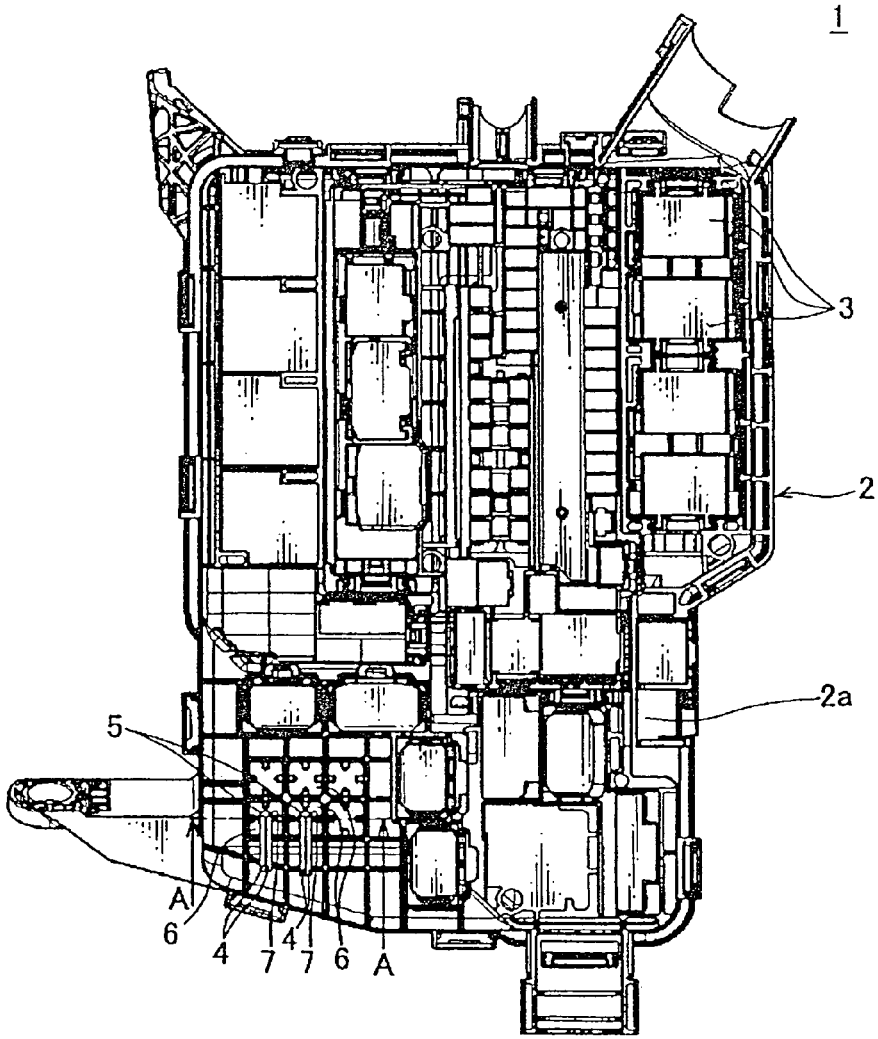
FIG. 1 is a planar view of an embodiment of an electric junction box in accordance with the present invention.
Figure 2:
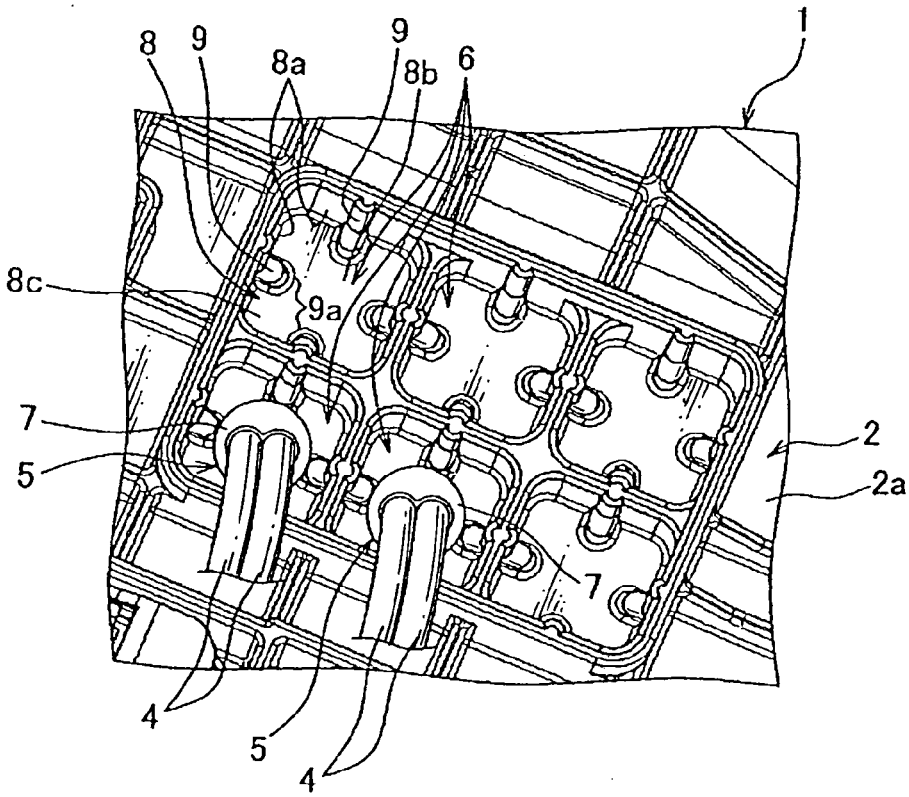
FIG. 2 is an enlarged perspective view of a receiving portion of the electric junction box depicted in FIG. 1.
Figure 3:
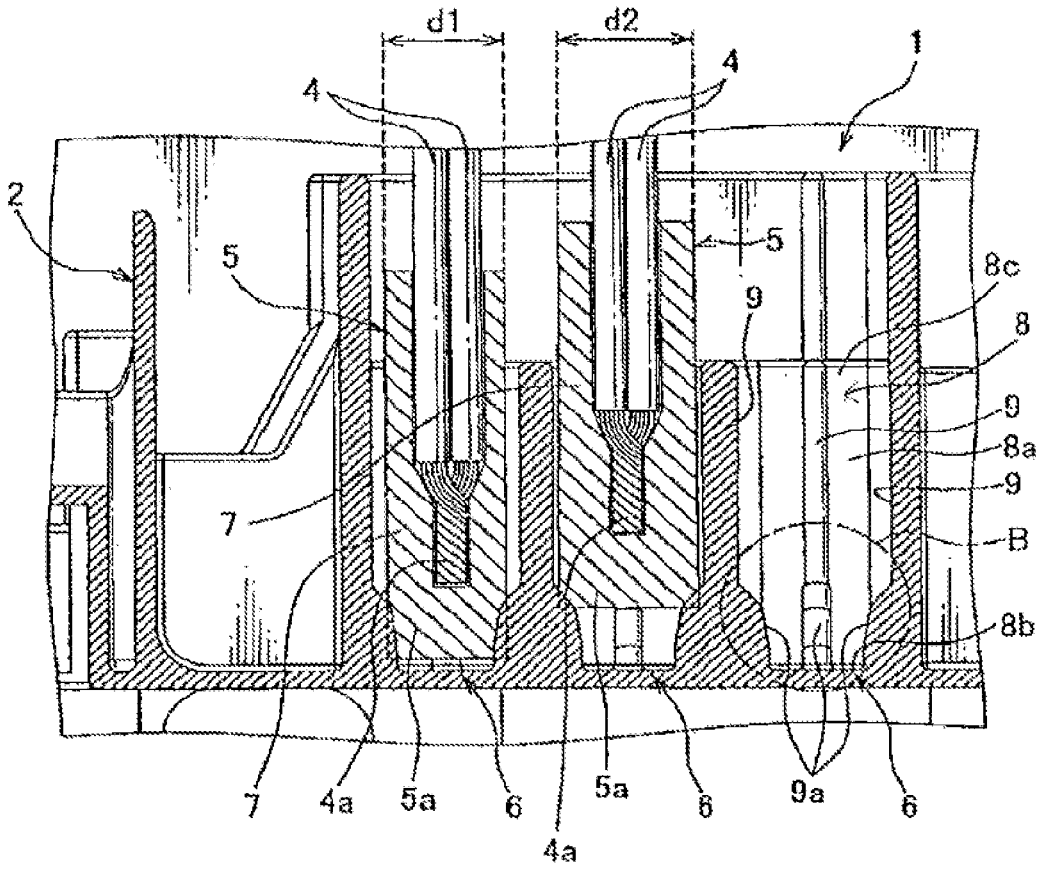
FIG. 3 is a cross sectional view taken along a line A-A of FIG. 1.
Figure 4:
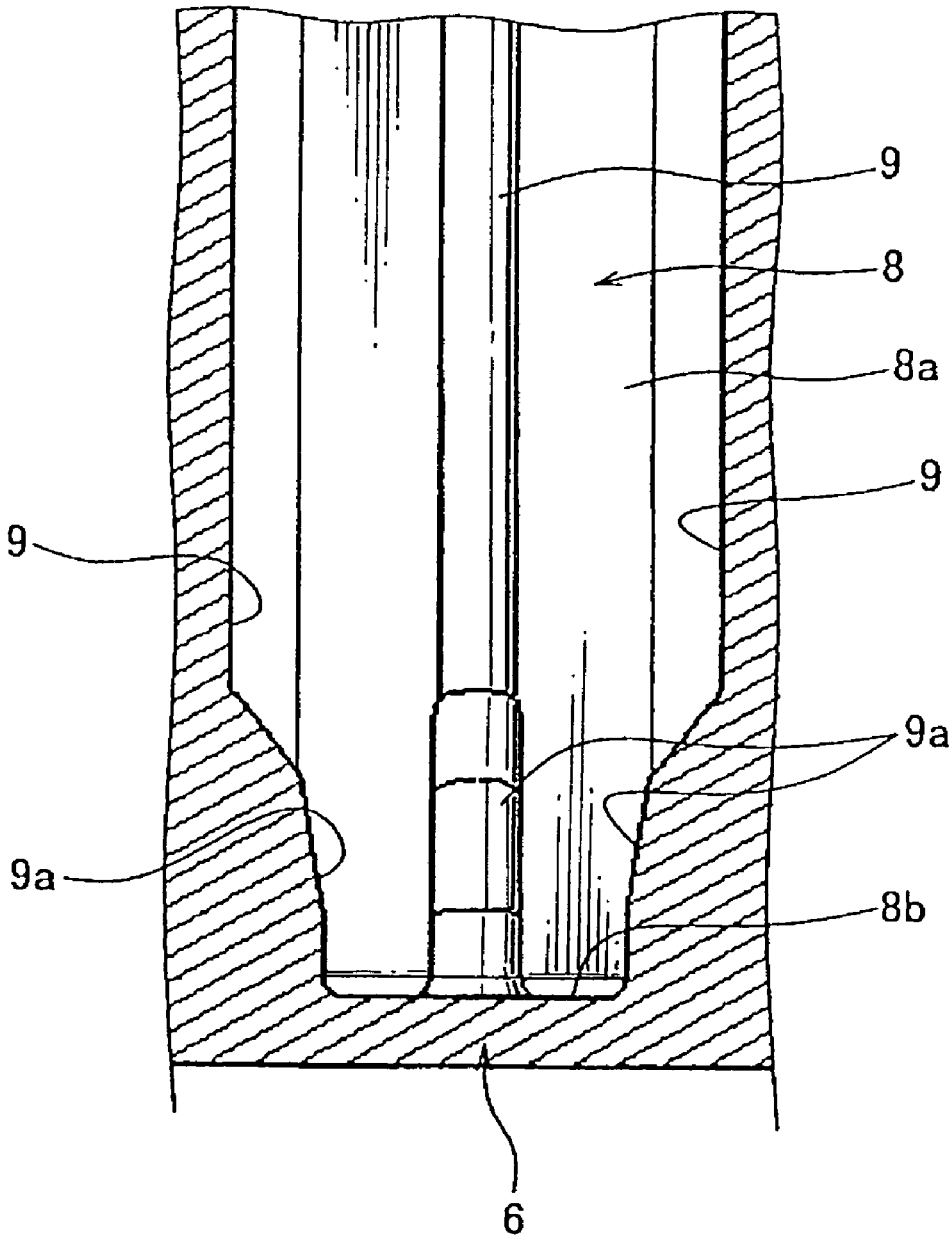
FIG. 4 is an enlarged perspective view of "B" circled by a dot line in FIG. 3.

An embodiment of an electric junction box in accordance with the present invention will be described hereinafter with reference to FIGS. 1 through 4. More specifically, FIG. 1 is a planar view of an embodiment of an electric junction box in accordance with the present invention. FIG. 2 is an enlarged perspective view of a receiving portion of the electric junction box depicted in FIG. 1. FIG. 3 is a partially cross sectional view taken along line A-A of FIG. 1. FIG. 4 is an enlarged perspective view of "B" circled by dot line in FIG. 3

An electric junction box in accordance with the present invention is suited to be mounted to, for example, an engine room for a vehicle, and is configured to supply electrical energy to a variety of electronic devices which are mounted to the above vehicle. As used herein, the term "an electric junction box" includes a "junction block", a "fuse block", a "relay box" and so on. These terms can be interchangeably used herein.

Referring to FIG. 1, an electric junction box 1 is shown to include a case body 2 formed of synthetic resin, and an upper case (not shown) disposed over the case body 2 and thus covering the upper face 2A of the case body 2.

The case body 2 is made tubular, and includes a portion 3 which an electronic part such as a relay and a fuse is attached or amounted to, and a receiving portion 6 capable of receiving a joint 5 of electrical conduits 4. In particular, the joint 5 is press-fitted into the receiving portion 6.

With reference to FIG. 3, the term "joint 5" as used herein refers to an area where the terminals 4*a* of the electrical conduits 4 are electrically connected to each other, and a cap 7 covering the terminals 4*a* is present.

The electrical conduit 4 is comprised of a conductor having a plurality of core wires twisting together, and an insulating covering disposed on the conductor. In other words, the electrical conduit 4 is so called an "electric insulated wire". The covering is partly eliminated from the electrical conduit 4 at the area of the terminal 4*a*. Accordingly, the conductor is exposed to outside at the terminal 4*a* of the electrical conduit 4. Furthermore, since the conductors of the electrical conduits 4 twist together, they are correspondingly electrically connected to each other. The electrical conduit 4 is configured to electrically connect electrical parts located in the electric junction box 1 to electronic devices mounted in the vehicle.

The cap 7 is bag-shaped, and is formed of a material which has a tendency to contract when heat is applied thereto. The cap 7 is configured to protect the terminal portion 4*a* from liquid such as water, and any damage. In addition, a plurality of terminals 4*a* is protected due to the cap 7 from being separated from each other.

Referring to FIGS. 1 to 3, the cap 7 is heat-contracted so as to come closely in contact with the outer surface of the electrical conduit 4 at the area of the joint 5. A tip portion 5*a* of the joint 5 is merely filled with a material for the cap 7. In other words, none of the terminals 4*b* of the electrical conduits 4 is disposed at the tip portion 5*a* of the joint 5. This tip portion 5*a* of the joint 5 corresponds to one end portion of the joint 5 in a longitudinal direction of the electrical conduit 4 disposed therein. The terminal 4*a* of the electrical conduit 4 is generally disposed in the middle of the joint 5 in a longitudinal direction of the electrical conduit 4. As shown in FIG. 2, the joint 5 is generally cylindrically-structured. As shown in FIG. 3, there is variation in the outer diameter (d1, d2) of the joints 5.

The plurality of receiving portions 6*a* is disposed adjacent to each other. Referring to FIG. 4, each receiving portion 6 is shown to include a tubular-shaped recess 8 having an approximately rectangular-shaped cross section and being configured to position the joint 5 therein, and a plurality of rib projections 9 disposed on an inner surface 8*a* of the recess 8. The rib projection 9 is a structure inwardly projecting from the inner surface of the recess 8. In accordance with the embodiment of the present invention, there are provided four rib projections 9 each of which is provided on each of four inner surfaces 8*a* (i.e., side surfaces) of the recess 8. Furthermore, the rib projection 9 generally linearly extends from an opening 8*c* to a bottom 8*b* inside the recess 8. As used herein, the term "inner surface 8*a*" refers to inner surfaces facing the opening 8*c*. Accordingly, the bottom 8*b* opposed to the opening 8*c* is not included the concept of the above term "inner surface 8*a*".

The Rib projection 9 has a tapered portion 9*a* (also called as a "tapered surface") that is inclined toward the bottom 8*b* thus approximating the center portion of the bottom 8*b*. Also, the tapered portion 9*a* is disposed adjacent to one end portion of the recess 8. More specifically, the tapered portion 9*a* is disposed adjacent to the bottom 8*b*. At the area of the tapered portion 9*a*, only the tip portion 5*a* of the joint 5 is disposed. As used in herein, the phrase "a position where only the tip portion 5*a* of the joint 5 is located" refers to a position where none of electrical conduits is present and only a material for the cap 7*b* is filled. In accordance with the above configuration, the tapered portion 9*a* digs into or bites into only the tip portion 5*a* of the joint 5. As a result, due to the taped portion 9*a* the tip portion 5*a* of the joint 5 is deformed.

In the receiving portion 6, the distance between the opposing inner surfaces 8*a* is made greater than an upper tolerance limit of the outer diameter of the joint 5. Furthermore, the distance between the opposing tapered portions 9*a* (i.e., tapered surfaces) is made smaller than the lower tolerance limit of the outer diameter of the joint 5.

The joint 5 is press-fitted into the receiving portion 6, as described below. Referring to FIG. 3, one joint 5 having a smaller outer diameter d1 is deeply inserted into the receiving portion 6, and is press-fitted into the receiving 6 such that the tapered portion 9*a* of the rib projection 9 bites into or digs into the tip portion 5*a* of the joint 5 in a relatively large amount. The other joint 5 having the greater outer diameter d2 is inserted into the receiving portion 6 such that it is disposed adjacent to the opening 8*c*, in comparison with the other joint 5 having the smaller outer diameter d1. In this case, the tapered portion 9*a* of the rib projection 9 bites into or digs into the tip portion 5*a* of the joint 5 in a relatively small amount. In this way, the above joint 5 is securely press-fitted into the receiving portion 6. Furthermore, while the other joint 5 having an outer diameter greater than the above diameter d2 is not shown, it will be inserted into the receiving portion 6 such that the tapered portion of the rib projection 9 relatively slightly bites into or digs into the tip portion 5*a* of the joint 5 in comparison with the joint 5 having the diameter of d2. In other words, the smaller the diameter of the joint 5 is, the deeper the tip portion 5*a* of the joint 5 is located inside the receiving portion 6. The deeper the tip portion 5*a* of the joint 5 is located, the greater the amount of the joint 5 that the tapered portion bites into is. When the joint 5 is press-fitted into the receiving portion 6, the tapered portion 9*a* bites into the circumference of the joint 5 overlaid therewith.

As used herein, the term "press-fitted" or "press-fitting" refers to a condition where the joint 5 is forced to insert into the receiving portion 6, and is continually retained inside the receiving portion 6.

In accordance with the embodiment of the present invention, since the receiving portion 6 includes a rib projection 9 disposed on the inner surface 8*a* of the recess 8, and the rib projection 9 has a tapered portion 9*a*, the amount of the joint 5 that the tapered portion 9*a* bites into is in inverse proportion to the outer diameter of the joint 5. In this way, the joint 5 can be easily and securely press-fitted into the receiving portion 6 regardless of its outer diameter. Moreover, since an adhesive tape, a pressure sensitive tape or sheet and so on are not needed to fix the joint 5 to the receiving portion 6, required prepare cost and efforts can be remarkably reduced.

In accordance with the present invention, the tapered portion 9*a* is disposed adjacent to one end portion (i.e., the bottom 8*b*) of the recess 8, and only the tip portion 5*a* of the joint 5 is disposed in the area of the tapered portion 9*a*. As a result, the tapered portion 9*a* merely bites into or digs into the tip portion 5*a* which is filled with a material for the cap 7 thus allowing the joint 5 to be securely press-fitted into the receiving portion 6. Furthermore, because the tapered portion 9*a* merely bites into or digs into the tip portion 5*a* in which none of the electrical conduits 4 is present, the conductor of the electrical conduit 4 can be prevented from any damage.

In accordance with the above embodiment of the present invention, the plurality of rib projections 9 is formed while surrounding the joint 5. However, the invention is not limited such a configuration. In other words, at least one rib projection falls within the concept of the present invention.

In accordance with the present invention, it is possible to provide an electric junction box having a receiving portion enabling a joint to be securely press-fitted thereinto, even if the outer diameter of the joint varies within a wide range. The amount of the joint that a tapered portion bites into is in inverse proportion to the outer diameter of the joint. Accordingly, the joint can be securely press-fitted into the receiving portion in a relatively simple way.

Preferably, the tapered portion is disposed in a position where only the tip portion of the joint is located, and extends from the bottom of the recess. Accordingly, the tapered portion digs into or bites into only the tip portion which is filled with a material for a cap. As a result, the joint can be securely press-fitted into the receiving portion. Also, since the tapered portion digs into or bites into only the tip portion where none of the electrical conduits is present, the conductor of the electrical conduit can be prevented from any damage.

The above embodiments and examples are given to illustrate the scope and spirit of the instant invention. These embodiments and examples will make apparent, to those skilled in the art, other embodiments and examples. These other embodiments and examples are within the contemplation of the present invention. Therefore, the instant invention should be limited only by the appended claims.

The invention claimed is:

1. An electric junction box, comprising:

a joint having an outer diameter in which terminals of electrical conduits are electrically connected to each other, the terminals being covered by a cap; and a receiving portion which the joint is press-fitted into, the receiving portion comprising a recess having an inner surface, with a diameter larger than the joint, facing an outer surface of the joint, and a rib projection disposed on the inner surface of the recess, the rib projection having a tapered portion inclined toward the bottom of the recess so as to approximate the center portion of the bottom and rib projection creating an area with a diameter smaller than the outer diameter of the joint, thereby deforming the joint.

2. The electric junction box in accordance with claim 1, the tapered portion extends from the bottom of the recess, and is arranged in a position where only a tip portion of the joint is located.

* * * * *